United States Patent [19]

Gallagher

[11] Patent Number: 4,839,491

[45] Date of Patent: Jun. 13, 1989

[54] METHOD FOR FORMING A METAL CYLINDRICAL CONTAINER

[75] Inventor: Thomas A. Gallagher, Chagrin Falls, Ohio

[73] Assignee: Van Dorn Company, Cleveland, Ohio

[21] Appl. No.: 145,620

[22] Filed: Jan. 19, 1988

Related U.S. Application Data

[63] Continuation-in-part of Ser. No. 120,471, Nov. 13, 1987.

[51] Int. Cl.[4] ..... B23K 11/32

[52] U.S. Cl. ..... 219/117.1; 219/64

[58] Field of Search ..... 219/64, 79, 117.1

[56] References Cited

U.S. PATENT DOCUMENTS 3,553,419 1/1971 Garver et al. ..... 219/79

*Primary Examiner*—Clifford C. Shaw

*Attorney, Agent, or Firm*—Body, Vickers & Daniels

[57] ABSTRACT

An improved method of forming a cylindrical metal can body is disclosed. The improvement includes forming special ears for the bale and orienting the ears in a specific direction so that the ears can be resistance welded to flat rectilinear sheet stock which can subsequently be accurately rolled into a cylindrical form with a closely controlled overlap.

5 Claims, 1 Drawing Sheet

METHOD FOR FORMING A METAL CYLINDRICAL CONTAINER

This application is a continuation-in-part of prior application Ser. No. 120,471 filed on or about Nov. 13, 1987 and entitled "RINGLESS PAINT CONTAINER" (the "parent application") which is incorporated, in its entirety, by reference herein.

This application relates generally to metal containers and more particularly to an improvement in the manufacture of cylindrical paint containers which use a wire bale or handle for carrying purposes and will be described with particular reference thereto.

BACKGROUND

In the parent application, incorporated by reference herein, a metal container is described which is of a ringless type. The container described in the parent application had several unique features, one of which included the use of bale ears or lugs into which the ends of a wire handle or bale were snapped for carrying the container. The ears are resistance welded to the container. This application relates to the manufacturing technique used in welding the lugs to any cylindrical container, whether of the ringless or ring type design.

Heretofore, the conventional method of manufacturing cylindrical metal paint containers, particularly of the gallon size, was to stamp the ear into a cup shape form, the cup having a base with an opening therethrough and a rim from which extended a circular flange. The metal, tin plated stock was stamped into a plurality of rectilinear sheets and each sheet was subjected to movement through several die forming stages which progressively indented the sheet to provide a recess for receiving the ears with the sheet stock then bent over the flanges of the ears to hold the ears in place. After the sheet was thus formed and clinched about the ears flange, the sheet was then formed into a cylindrical form and the width edge of the sheet crimped back onto itself for a soldered side seam or overlapped for a resistance welded side seam. The bottom of the container was then double seamed to one end of the cylinder and a ring double seamed to the other end of the cylinder in accordance with conventional practices.

Applying the ears to the container by clinching the container about the ears, while occurring at a fast rate is nevertheless a limiting factor in the capacity of a can manufacturing line resulting in a lesser production rate than that which is otherwise possible to achieve or alternatively requiring more than one ear applying station to maintain a high throughput capacity. Importantly, it has been determined that as the metal is stretched while it passes through the dies and is clinched about the flanges of the ears, the straightness of the width edges of the sheet is distorted. The straight edge distortion does not occur in a repeatable, consistent manner, but is irregular and when the longitudinal side seam is to be resistance welded, the overlap must be increased to compensate for the irregularity. In a ringless can design, the resistance welded side seam becomes pronounced and can adversely affect the seal of the lid. In a conventional can design, the overlap becomes of concern when the container is used to store water based paints. For water based paint applications the seam is coated to prevent rust by a spray striped system. When the overlap becomes significant, the coating cannot penetrate the space between the overlapped metal. An overlap of about 0.4 to 0.5 mm can be effectively penetrated with a spray striped system. Unfortunately, the distortion of the straight edge from clinching the ears typically can equal 1 mm. This fact generally dictates that resistance welding of the side seam is not possible for water based, metal paint containers which clinch the ears in the method described above and necessitates the more expensive, crimped soldered seam method.

The prior art has attempted to overcome such limitations and has applied the ears to the can bodies by projection welding. However, the ears have been applied after the body has been formed into a cylindrical shape and the longitudinal side seam welded. When the ears are applied to the cylindrical bodies, the fixture required to spot weld the ears to the rounded body limit the time required for the operation to about 20 or so can bodies per minute. This in turn limits the throughput of the line or alternatively requires a plurality of expensive ear welding stations. Attempts to projection weld the ears prior to forming the rectilinear sheet into a cylinder resulted in a flattening of the cylinder where the ears were applied or the ears "popping off" if they were not adequately welded.

It is also noted that the present state-of-the art within the metal can industry does not permit butt-welding of the container's longitudinal side seam but that efforts are being made to utilize laser technology to effect butt-welding. When such developments occur, it is quite likely that the straightness of the flat plate's width edges will have to be carefully controlled and the distortion of the edge's straightness by the ear clinching process will not be possible.

SUMMARY OF THE INVENTION

It is thus a principal object of the present invention to provide a method for manufacturing a cylindrical metal container which permits the ears to be applied by resistance welding to the container in a fast and efficient manner.

This object along with other features of the invention is achieved in a method for forming the metal cylindrical container for paint cans and the like from a stock of tin coated sheet metal cut into a plurality of rectilinear sheets with each sheet having a pair of length edges approximately equal to the diameter of the container and a pair of width edges approximately equal to the height of the container. The improvement includes the steps of providing two bale lugs or ears for each sheet, each ear having a cup shaped body with the body having a circular base portion with an opening therethrough for receiving a wire bale and a circular rim portion and each ear further having a pair of diametrically opposed generally rectilinear tabs extending from the rim. A pair of ears are positioned at discrete points on a flat sheet with each ear orientated so that its tabs are generally perpendicular to the length edges and generally parallel to the width edges and the tabs are then resistance welded to the sheet while the sheet is in a flat position. The sheet is then accurately rolled about its length edges into a smooth cylindrical form with one width edge overlapping the other width edge whereat the width edges can be longitudinally seamed and the container subsequently formed in a conventional manner.

In accordance with another feature of the invention, the resistance welding of the tabs to the sheet stock does not distort the straightness of the width edges thus permitting the overlapping step to occur so that one lateral edge does not overlap the other lateral edge more than about 0.04 millimeter, thus permitting a fast, side seam resistance welding step to occur while minimizing the metal used to manufacture the container and reducing the cost thereof.

In accordance with still another feature of the invention, the tabs are preferably welded to the flat sheet stock by resistance welding thus permitting the welding thereof at a rate of approximately 250 sheets per minute, a significant increase when compared to the methods used in projection welding the ears in the prior art.

Accordingly, it is another object of the invention to provide a method for applying the ears to the sheet metal stock of a metal container which permits the overlap of the width edges to be accurately controlled.

It is another object of the subject invention to provide an improved method of manufacturing cylindrical metal container which minimizes the amount of metal stock otherwise utilized in the process.

Yet another object of the invention is to securely and permanently fasten the ears to a flat metal rectangular sheet which can be accurately and smoothly rolled into a cylindrical can body.

These objects and other features of the present invention will become apparent from the following description of species thereof taken together with the accompanying drawings.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

FIGS. *3a*, *3b* and *3c* are schematic views illustrating conventional process steps used in forming the can body.

DETAILED DESCRIPTION OF THE PREFERRED EMBODIMENT

Figure 2:
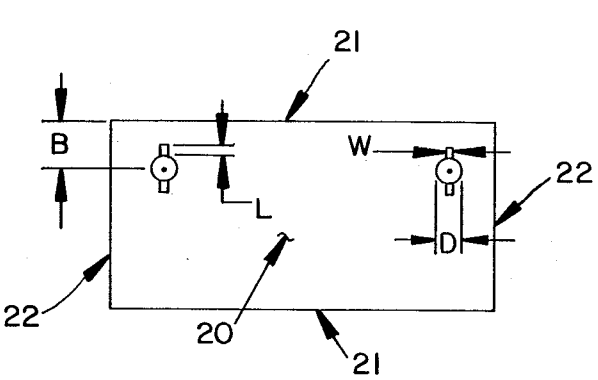
FIG. 2 is a top plan view of the ears applied to the flat can sheet.

Referring now to the drawings wherein the showings are for the purpose of illustrating the preferred embodiment of the invention only and not for the purpose of limiting the same, the invention will be described with reference to forming a conventional, metal, cylindrical one gallon paint container. Such containers are formed from tin plated, sheet metal stock with the gauge of the stock typically specified in pounds. For one gallon paint containers, the gauge is usually between 75 lbs. and 90 lbs. with a tin coating of 0.25 lbs. The actual thickness of the stock is between 0.0083 and 0.0099 inches. Good results have been obtained with a gauge thickness of 0.0094 and a tin coating of 0.25 lbs. although it is contemplated that the invention will work within the range of stock specified for the one gallon container sizes.

Figure 1:
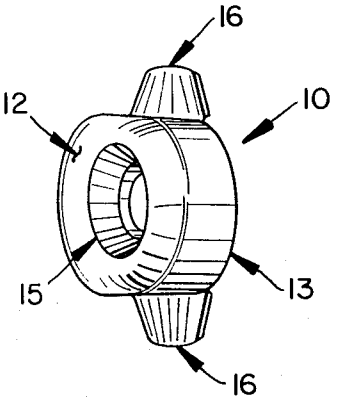
FIG. 1 is a perspective view of the ear of the present invention which is to be applied to the can body.

Referring now to FIG. 1, there is shown a cup-shaped ear 10 for holding the ends of a bale or wire handle for carrying the container. Cup-shaped ear 10 has a base 12 and a circular rim 13. Within base 12 is a central opening 15 extending therethrough which receives the ends of the bale and extending from diametrically opposite sides of rim 13 is a pair of mounting tabs 16. Cup-shaped ear 10 is formed by conventional die-pressing operation from a stock which is 95 lb. (0.0105") tin plate.

Referring now to FIGS. 1 and 2, a diameter D of base 12 is about 0.750 inches and the width W of mounting tabs 16 is about 40 percent of diameter D and the length L of tabs 16 is about 25 percent of diameter D.

In the conventional can manufacturing process, the first step is to form a cylindrical body from a flat piece of sheet metal stock which has been sheered into a rectilinear plate 20 having parallel longitudinally extending length edges 21 approximately equal to the diameter of the cylindrical container and parallel width edges 22 approximately equal to the height of the paint container. Positioned on rectilinear plate 20 are a pair of ears and they are spaced apart from one another a distance equal to the diameter of the paint container. For a standard one gallon paint container, the diameter would be 6.500" and the dimensions "a" and "b" shown in FIG. 2 would equal 5.110" and 1.745" respectively.

Figure 3B:
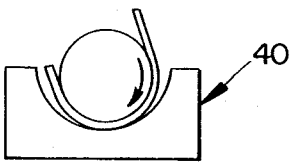

Because sheet 20 is flat, ears 10 can be accurately positioned thereon and easily clamped or otherwise positioned for welding tabs 16 to rectilinear sheet 20. For purposes of explanation, a conventional Larson projection welding machine could be used to weld tabs 16 to rectilinear sheet 20. Such machine has the capacity to weld 0.3 ears per second which, when used with conventional feed mechanisms customarily used in can lines, would produce 20 container bodies per minute. It is specifically contemplated that tabs 16 will be resistance welded to rectilinear sheet 20 by a resistance welding machine 30 as shown diagrammatically in FIG. 3A. Such resistance welding machines could be of the type used to effect continuous side seam welding (identified hereafter) and which would be modified to resistance weld the tabs as the sheet passes by. Specially modified projection welders could significantly reduce the welding time and it is anticipated that as many as 250 rectilinear sheets per minute could be fed through such specially adapted projection welder. When the ears are welded to rectilinear shape 20, the thickness of the sheet plus mounting tabs 16 would be about twice the thickness of rectilinear sheet 20 and the welded connections would occur at only 2 points which are spaced vertically or parallel to width edge 22 and perpendicular to length edge 21 which, importantly, permits rectilinear sheet 20 to be rolled into a true cylinder using conventional cylinder forming rolls 40 schematically illustrated in FIG. *3b*. A conventional cylindrical roll forming machine such as Model No. EWL-250 supplied by Soudronic A.G. or Model No. FBW-22-420-S supplied by Fael A.G. used in prior art devices can be employed. It should be noted that the machines described are roll forming machines in distinction to other conventional cylindrical forming machines which in theory could also be used. In the sense that the welded connection of the tabs 16 to rectilinear plate 20 must not loosen during rolling while at the same time permit accurate rolling without denting the side of the can, the dimensional relationships set forth above are critical. In the roll forming operation of FIG. *3b*, the overlap between width edges 22 can be carefully controlled and in point of fact is carefully controlled to be no more than 0.5 mm.

Figure 3C:
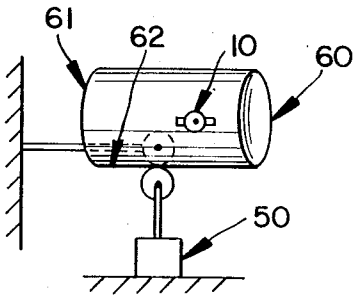
Figure 3A:
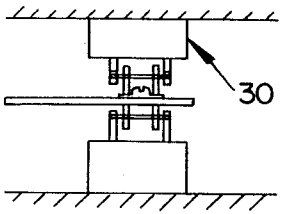

With rectilinear sheet 20 thus rolled into a cylinder, the overlap width edges 22 are continuously welded by a conventional side welder such as diagrammatically illustrated as 50 in FIG. 3*c*. Typical, continuous side seam welders which could be employed to effect longitudinal welding of the side seam could be Model No. EWL-250supplied by Soudronic A.G. or Model No. FBW-22-420-S supplied by Fael A.G. Once the side seam is welded a cylindrical can body 60 is formed and the can body is then subjected to the normal steps in the can manufacturing process which include seaming a bottom to one end of the can body 61 and a ring to the other end of the can body 62 or, if the can body is of the ringless type as described in the parent application, end 62 is approximately profiled. Such steps are conventional in the can manufacturing art and do not, per se, form a part of the invention and will not be described in detail herein.

Figure 4:
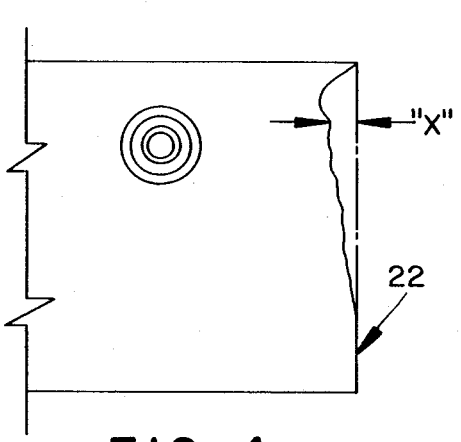
FIG. 4 is an exaggerated view illustrating the deformation of the sheet stock edge which occurred in the prior art.

As noted in the background portion of the specification, rectilinear sheet 20 was heretofore subjected to a series of dies which would stamp indentations in the rectilinear sheet at the position where ears 10 are welded. Ears 10 having an annular flange instead of tabs 16 would then be placed in the indentations and the metal clinched over the flange to maintain the ears in place. Since the metal will simply stretch, there was no problem in forming the cylinder. However, during the die forming operation, the straightness of width edge 22 would distort and the distortion, which was irregular in occurrence and is shown by dimension X in FIG. 4, would be in excess of 0.5 mm and sometimes as high as 1.0 mm which is more than twice the distance permissible for water based paint containers using conventional stripe spray systems noted above. This in turn would require a larger overlap of the width edges in the side seam welding station of FIG. 3*c* (if soldered side seams were not employed) and to cause the seam to fuse evenly, notwithstanding the distortion, would result in a higher capacity side seam welder 50 or a slower operating welder 50 than that which would otherwise be employed. In accordance with the present invention, distortion X is removed and the side seam overlap can be carefully controlled to the dimension noted and, theoretically even permit butt welding of width edges 22. However, butt welding, as a practical matter, is not feasible at the present time for the thicknesses described and for the tolerances which can be maintained on the straightness of width edges 22. Importantly, by dimensioning mounting tabs 16 and orientating them in a straight line direction parallel to width edge 22 and not parallel to longitudinal edge 21, a true cylinder can be rolled as shown in the conventional cylinder forming step of FIG. 3*b*.

It is thus the essence of my invention to provide an improvement in manufacturing cylindrical metal containers which permits the permanent application of ears to the rectilinear sheet in a flat state in a manner which permits the cylinder of the can body to be subsequently formed in an accurate manner and without distorting the straightness of the width edges of the rectilinear sheet.

Having thus described my invention, I claim:

1. In a method for forming a metal cylindrical container for paint and the like from a stock of tin coated sheet metal cut into a plurality of flat rectilinear sheets, each sheet having a pair of length edges approximately equal to the circumference of said container and a pair of width edges approximately equal to the height of said container, the improvement comprising the following steps performed sequentially in the order set forth below:

(a) providing two bale ears for each sheet, each ear having a cup shaped body, said body having a base portion with an opening therein for receiving a wire bale and a circular rim portion, each ear having a pair of diametrically opposed generally rectilinear tabs extending from a portion of said rim portion;

(b) positioning a pair of ears at discrete locations on a flat sheet, each ear orientated so that both of its tabs extend in an aligned direction generally parallel to said width edges;

(c) resistance welding said tabs to said sheet at said locations;

(d) rolling said sheet about said length edges into a cylinder with one of said width edges overlapping the other width edge; and (e) seaming said width edges.

2. The method of claim 1 wherein said one width edge does not overlap more than about 0.5 mm the other width edge in said rolling step and said seaming step comprises continuously resistance welding said overlapped width edge to the rolled cylindrical body.

3. The method of claim 2 wherein said tabs are resistance welded to said flat stock at a rate of about 250 pairs of tabs/minute.

4. The method of claim 3 wherein the width of each generally rectangular tab is about 40% of the diameter of said rim portion and is positioned to extend generally parallel to said sheet's length edge; the length of each generally rectangular tab is about 25% of the diameter of said rim and is positioned to extend generally parallel to said sheet's width edge; and each pair is positioned on said flat sheet in step (b) a distance apart from one another which is equal to the diameter of said cylinder when formed in step (d).

5. The method of claim 4 wherein said container is a standard one gallon paint container, and the gauge of said stock is between 75 lbs and 90 lbs with a tin coating of about 0.25 lbs and said ear is formed from tin plated stock having a gauge of about 95 lbs.

* * * * *